US006009840A

United States Patent [19]

Haumann et al.

[11] Patent Number: 6,009,840

[45] Date of Patent: Jan. 4, 2000

[54] METHOD FOR OPERATING A BOILER PLANT

[75] Inventors: Jürgen Haumann, Rekingen; Hans Peter Knöpfel, Besenbüren, both of Switzerland; Thomas Sattlemayer, Erding, Germany

[73] Assignee: ABB Research Ltd., Zurich, Switzerland

[21] Appl. No.: 09/032,842

[22] Filed: Mar. 2, 1998

[30] Foreign Application Priority Data

Mar. 18, 1997 [EP] European Pat. Off. ..... 97810163

[51] Int. Cl.[7] ..... F22B 33/00

[52] U.S. Cl. ..... 122/1 R; 431/62; 110/173 B

[58] Field of Search ..... 122/1 R, 13.1, 122/17; 431/62, 63, 6, 346; 110/172 B

[56] References Cited

U.S. PATENT DOCUMENTS

| | | | |
|---|---|---|---|
| 2,623,482 | 12/1952 | Ayers | 110/173 B |
| 2,835,230 | 5/1958 | Cleaver et al. | 110/173 B |
| 4,940,042 | 7/1990 | Moore, Jr. et al. | 126/344 |
| 5,029,533 | 7/1991 | Hengelmolen | 110/173 B |
| 5,636,619 | 6/1997 | Poola et al. | 123/585 |

FOREIGN PATENT DOCUMENTS

| | | |
|---|---|---|
| 0436113A1 | 7/1991 | European Pat. Off. . |
| 0617231A1 | 9/1994 | European Pat. Off. . |
| 0629817A2 | 12/1994 | European Pat. Off. . |
| 3740047A1 | 6/1989 | Germany . |

*Primary Examiner*—Philip H. Leung
*Assistant Examiner*—Jiping Lu
*Attorney, Agent, or Firm*—Burns, Doane, Swecker & Mathis, L.L.P.

[57] ABSTRACT

When a boiler plant (100), which is equipped with an air plenum (104), is in operation, during the startup phase the admission pressure in this air plenum (104) is lowered in terms of time and amount via a blowoff device (106) with respect to combustion air (7) and startup air (105) made available from this air plenum (104). The air coefficient to the burner is consequently reduced. This ensures that, by means of such a near-stoichiometric fuel/air mixture, favorable ignition conditions are provided in the burner and the pollutant emissions during the startup phase are greatly reduced.

1 Claim, 4 Drawing Sheets

Fig. 1
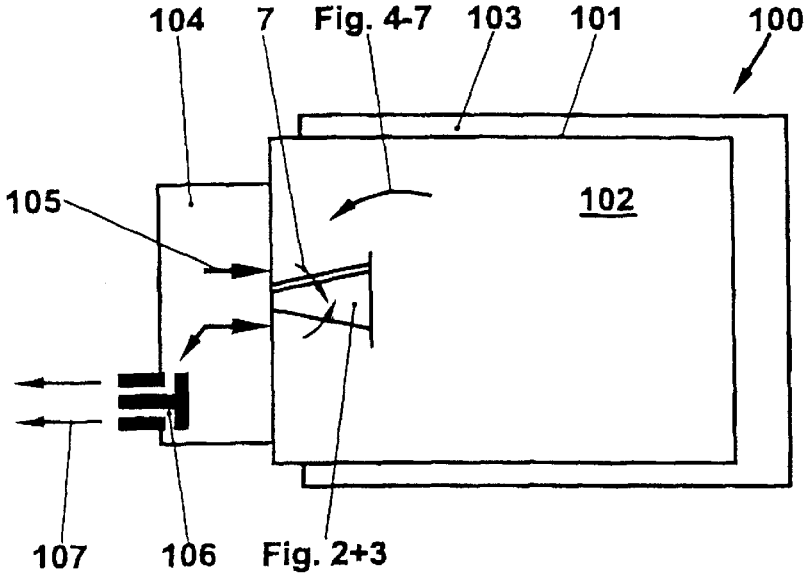
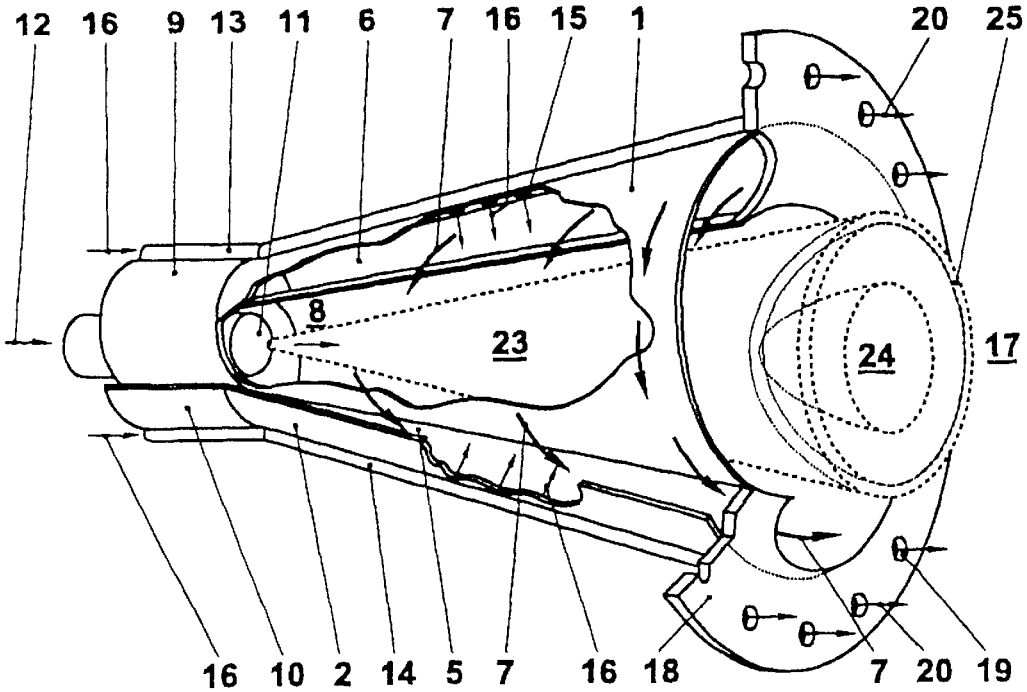
Fig. 2

1
2
5
6
7
13
14
27
28
29
30
31
31a
32
32a
200

26
31
31a
32
32a
33

METHOD FOR OPERATING A BOILER PLANT

BACKGROUND OF THE INVENTION

1. Field of the Invention

The invention relates to a boiler plant for carrying out this method.

2. Discussion of Background

Particularly in the case of premixing burners with flue gas recirculation, during the startup operation and, in particular, during the ignition air instead of flue gas is conveyed into the reaction zone in addition to the normal combustion air. Due to the undesirable increase in the air coefficient, the ignition of the fuel/air mixture is hindered or made impossible, flame stabilization is weakened and pollutant emissions during startup, in particular CO and UHC (=unburnt hydrocarbons), are increased.

Admittedly, the undesirable increase in the air coefficient in the startup operation can be prevented by means of other measures. At the forefront, here, is the possibility of regulating the startup by throttling the blower due to a reduced motor speed. Such precaution is costly, however, and, in the event of installation at a later date, is highly complicated, since the blower would have to be equipped with a frequency converter, which is why such a measure is hardly acceptable for use in boiler plants.

SUMMARY OF THE INVENTION

The invention intends to remedy this. The object on which the invention, as defined in the claims, is based, is, in a method of the type initially mentioned, to propose steps which from every aspect favorably influence the operation of such a boiler plant.

This is achieved by providing a measure whereby, during the startup operation, a fraction of air is blown off through an orifice out of the air plenum, which supplies the burner with air and into which air is conveyed under a specific admission pressure by means of a preceding blower, said air fraction being blown off in such a way that the admission pressure in the plenum is consequently lowered, the air mass flow through the burner is reduced and therefore the air coefficient is decreased.

The essential advantage of the invention is to be seen in that, by means of a near-stoichiometric fuel/air mixture, favorable ignition conditions are provided in the burner and the pollutant emissions during startup are greatly reduced.

Particularly in the case of a burner operated with a liquid fuel and having passive flue gas recirculation, the reduced burner mass flow and the higher flame temperatures result in more rapid heating of the system which leads to better drop evaporation and intermixing. Consequently, the pollutant emissions, in particular CO and UHC, are drastically reduced not only during the ignition, but during the entire startup phase.

Advantageous and expedient developments of the solution according to the invention for achieving the object are defined in the further dependent claims.

Exemplary embodiments of the invention are explained in more detail below with reference to the drawings. All the elements not necessary for an immediate understanding of the invention have been omitted. Like elements are provided with the same reference symbols in the various figures. The direction of flow of the media is indicated by arrows.

BRIEF DESCRIPTION OF THE DRAWINGS

A more complete appreciation of the invention and many of the attendant advantages thereof will be readily obtained as the same becomes better understood by reference to the following detailed description, when considered in connection with the accompanying drawings, wherein:

FIG. 1 shows a boiler plant which is operated by means of a premixing burner, with a device for regulating the startup air for a burner with flue gas recirculation, FIG. 2 shows a perspective illustration of a premixing burner for operating the boiler plant.

DESCRIPTION OF THE PREFERRED EMBODIMENTS

Figure 3:
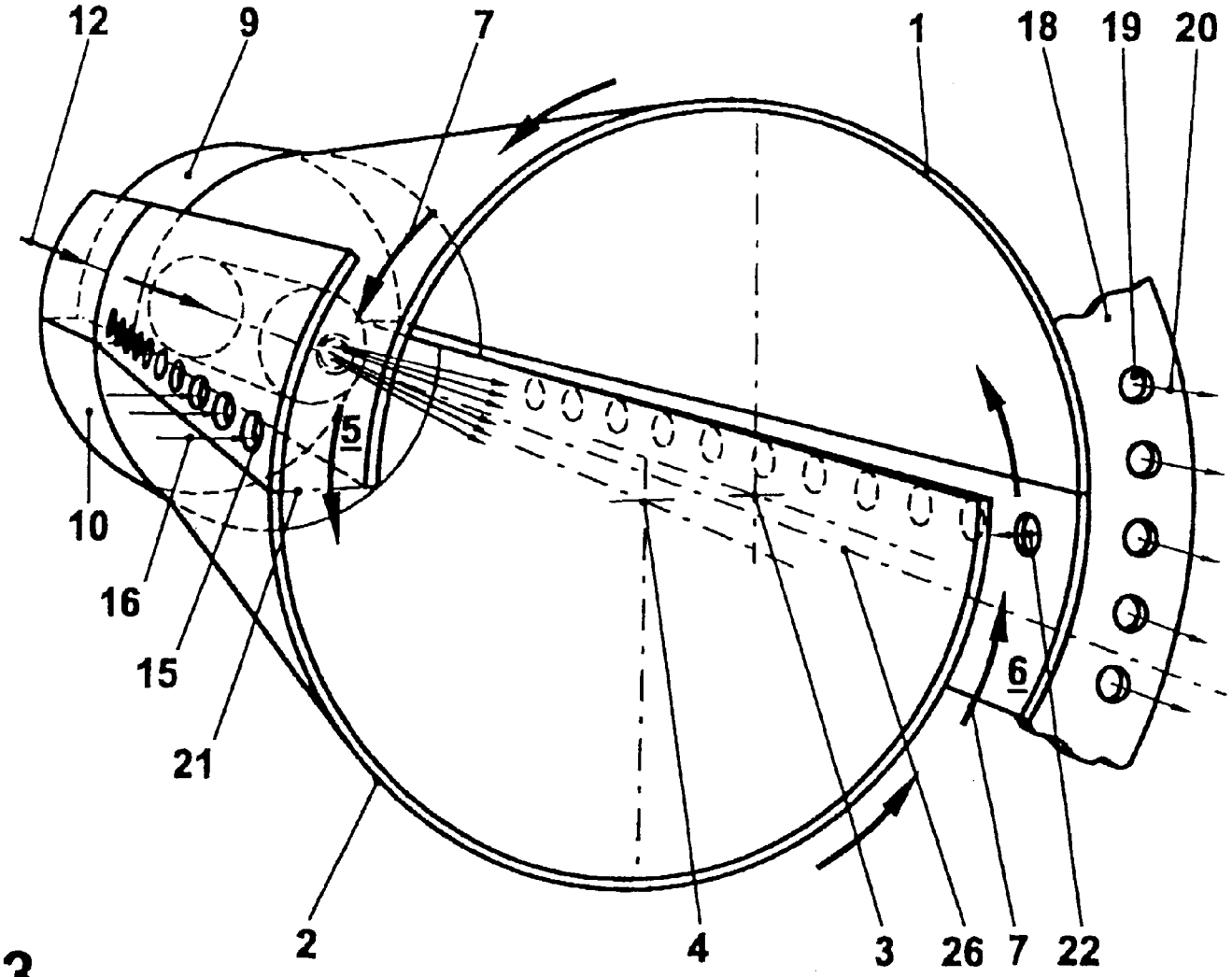
FIG. 3 shows a further perspective illustration of this premixing burner from another view in simplified form.

Referring now to the drawings, wherein like reference numerals designate identical or corresponding parts throughout the several views, FIG. 1 shows a boiler plant 100, such as is conventionally used for heating systems. This boiler plant consists essentially of a combustion space 102 which is formed from a flame tube 101 and is surrounded by a heat resistant bulkhead 103. The boiler plant is operated, here, by means of a premixing burner which is described with reference to FIGS. 2 and 3. However, this boiler plant does not have to be operated solely by means of the premixing burner illustrated; other types of burner may also be used. On the head side, the combustion space 102 has an air plenum 104 which supplies the premixing burner with air. This air plenum 104 is preferably fed by means of a preceding blower, not illustrated in any more detail, which delivers air at a specific admission pressure. During the startup phase, a fraction of the air introduced continuously into the air plenum 104 is taken off by means of a blow-off device, so that the admission pressure in this air plenum 104 falls correspondingly. This ensures that the air mass flow for operating the burner (cf. FIGS. 2 and 3, reference 7) and startup air 105 introduced in order to promote a low-pollutant startup phase is reduced. By means of this precaution, the air coefficient in the combustion process of the premixing burner is decreased, as a result of which, by means of this near-stoichiometric fuel/air mixture, favorable ignition conditions are provided in the premixing burner and the pollutant emissions during the startup phase are greatly reduced. The startup air 105, likewise coming from the air plenum 104, is injected in the premixing burner at specific suitable points, and, even when this startup air 105 is being introduced, the promotion of flame stabilization, the increase in the quality of the ignition behavior and the minimization of pollutant emissions during the startup phase are at the forefront. The blowoff device consists of a solenoid valve 106 which opens an orifice 107 to the outside. Control of this solenoid valve 106 when the admission pressure in the air plenum 104 is lowered during the startup phase can be carried out in a simple way, and, of course, other directly controlled blowoff devices are also possible here. Lowering can be adapted in terms of time and amount to the respective conditions. Autonomous startup air management via a separate solenoid valve can also be carried out. Particularly when the premixing burner is operated with a liquid fuel and with passive flue gas recirculation (cf. FIGS. 4–7), the reduced air mass flow to the premixing burner and the higher flame temperatures result in more rapid heating of the system, this heating leading to better drop evaporation and premixing of said liquid fuel. The pollutant emissions are thereby drastically reduced not only during ignition, but also during the entire startup phase.

FIG. 2 shows a perspective illustration of a premixing burner. To understand the subject better, it is advantageous if at least FIG. 3 is also referred to at the same time when FIG. 2 is examined. The main purpose of these two figures is to highlight the nature and functioning of such a burner.

The premixing burner according to FIG. 2 consists of two hollow conical part bodies 1,2 which are nested one in the other so as to be offset to one another and which are operated with a gaseous and/or liquid fuel. The term "conical" not only refers, here, to the cone shape shown, characterized by a fixed aperture angle, but also includes other configurations of the part bodies, such as a diffuser or diffuser-like shape and a confuser or confuser-like shape. These shapes are not illustrated particularly in the present case, since the average person skilled in the art is readily familiar with them. The offset of the respective center axes or longitudinal axes of symmetry of the part bodies 1,2 to one another (cf. FIG. 3, references 3,4) leaves a tangential air inlet duct 5,6 free on each of the two sides in a mirror-symmetrical arrangement, the combustion air 7 flowing through said ducts into the interior of the premixing burner, that is to say into the conical cavity 8. The two conical part bodies 1,2 each have a cylindrical initial part 9,10, said initial parts likewise being offset to one another in a similar way to the above mentioned part bodies 1,2, so that the tangential air inlet ducts 5,6 are present over the entire length of the premixing burner. A nozzle 11 for the preferable atomization of a liquid fuel 12 is accommodated in the region of the cylindrical initial part, in such a way that the injection of said nozzle coincides approximately with the narrowest cross section of the conical cavity 8 formed by the part bodies 1,2. The injection capacity and the operating mode of this nozzle 11 depend on the predetermined parameters of the respective premixing burner. If required, the fuel 12 injected by the nozzle 11 may be enriched with a recirculated waste gas; it is then also possible to bring about the complimentary injection of a quantity of water by means of the nozzle 11.

The premixing burner may, of course, be designed purely conically, that is to say without cylindrical initial parts 9,10. Furthermore, the part bodies 1,2 each have a fuel line 13,14, said fuel lines being arranged along the tangential inlet ducts 5,6 and being provided with injection orifices 15, through which preferably a gaseous fuel 16 is injected into the combustion air 7 flowing past there, as symbolized by arrows 16, this injection at the same time forming the fuel injection plane (cf. FIG. 3, reference 22) of the system. These fuel lines 13,14 are placed preferably at the latest at the end of the tangential inflow, prior to entry into the conical cavity 8, this being in order to ensure an optimal air/fuel mixture.

On the combustion space side, the premixing burner has a front plate 18 serving as anchoring for the part bodies 1,2 and having a number of bores 19, through which, if required, a mixing or cooling air 20 is supplied to the front part of the combustion space 17 or its wall.

If, as already described, the premixing burner is operated solely by means of a liquid fuel 12, this takes place via the central nozzle 11, this fuel 12 then being injected into the conical cavity 8 or into the combustion space 17 at an acute angle. A conical fuel profile 23 is therefore formed out of the nozzle 11 and is surrounded by the rotating combustion air 7 flowing in tangentially. The concentration of the injected fuel 12 is continuously reduced in the axial direction to an optimal mixture by means of the inflowing combustion air 7.

If the premixing burner is to be operated with a gaseous fuel 16, this may also, in principle, take place via the central fuel nozzle 11, but such an operating mode will preferably be carried out via the injection orifices 15, the formation of this fuel/air mixture occurring directly at the end of the air inlet ducts 5,6.

When the liquid fuel 12 is injected via the nozzle 11, the optimal homogeneous fuel concentration is achieved over the cross section at the end of the premixing burner. If the combustion air 7 is additionally preheated or enriched with a recirculated waste gas, this assists the evaporation of the liquid fuel 12 in a sustained manner within the premixing stage induced by the length of the premixing burner. Reference is made to FIGS. 4–7 as regards the admixing of a recirculated flue gas.

The same considerations also apply when liquid fuels instead of gaseous fuels are to be supplied via the fuel lines 13,14.

In the design of the conical part bodies 1,2 with a view to increasing the flow cross section and the width of the tangential air inlet ducts 5,6, it is necessary per se to adhere to narrow limits, so that the desired flow field of the combustion air 7 can be established at the exit of the premixing burner. The critical swirl coefficient is established at the exit of the premixing burner: a backflow zone 24 (vortex breakdown) is also formed there, with a stabilizing effect with regard to the flame front 25 taking effect there, in the sense that the backflow zone 24 performs the function of a bodyless flame holder.

The optimal fuel concentration over the cross section is achieved only in the region of the vortex breakdown, that is to say the region of the backflow zone 24. Only at this point does a stable flame front 25 then occur. The flame stabilizing effect is obtained in the direction of flow along the cone axis as a result of the swirl coefficient formed in the conical cavity 8. A flashback of the flame into the interior of the premixing burner is thus prevented.

It must be said, in general, that a minimization of the throughflow orifice of the tangential air inlet ducts 6,7 is predestined to form the backflow zone 24 from the end of the premixing stage. Furthermore, the design of the premixing burner is eminently suitable for varying the throughflow orifice of the tangential air inlet ducts 5,6 as required, with the result that a relatively large operational band width can be covered without varying the overall length of the premixing burner. Of course, the part bodies 1,2 can also be displaced relative to one another in another plane, as a result of which it is even possible, as emerges from FIG. 4, to have an overlap relative to the air inlet plane into the conical cavity 8 (cf. FIG. 3, reference 21) of said part bodies, in the region of the tangential air inlet ducts 5,6. It is then also possible for the part bodies 1,2 to be nested spirally one in the other by means of an opposed rotational movement.

By virtue of a more homogeneous mixture formation, achievable in this premixing burner, between the injected fuels 11,12 and the combustion air 7, lower flame temperatures, and therefore lower pollutant emissions, in particular lower NOx values, are obtained. These lower temperatures then reduce the thermal load on the material at the burner front and, for example, ensure that special treatment of the surface is not absolutely necessary.

As regards the number of air inlet ducts, the premixing burner is not restricted to the number shown. A larger number is advisable, for example, where it is important for premixing to take place over a wider range or for the swirl coefficient and therefore the formation of the backflow zone 24, which depends on this, to be influenced correspondingly by means of a larger number of air inlet ducts.

Premixing burners of the type described here are also those which are based on a cylindrical or quasi-cylindrical tube for achieving a swirl flow and in which the inflow of the combustion air to the interior of the tube is brought about via likewise tangentially directed air inlet ducts and a conical body having a cross section decreasing in the direction of flow is arranged inside the tube, a critical swirl coefficient at the exit of the burner also being achievable with this configuration.

FIG. 3 shows the same premixing burner according to FIG. 2, but from a different perspective and in a simplified illustration. This FIG. 3 is intended essentially to serve for a perfect understanding of the configuration of this premixing burner. In particular, the FIG. 3 shows very clearly the offset of the two part bodies 1,2 to one another with respect to the main center axis 26 (=burner axis) of the premixing burner, said axis corresponding to the main axis of the central fuel nozzle 11. This offset induces per se the size of the throughflow orifices of the tangential air inlet ducts 5,6. The center axes 3,4 run parallel to one another here.

Figure 4:
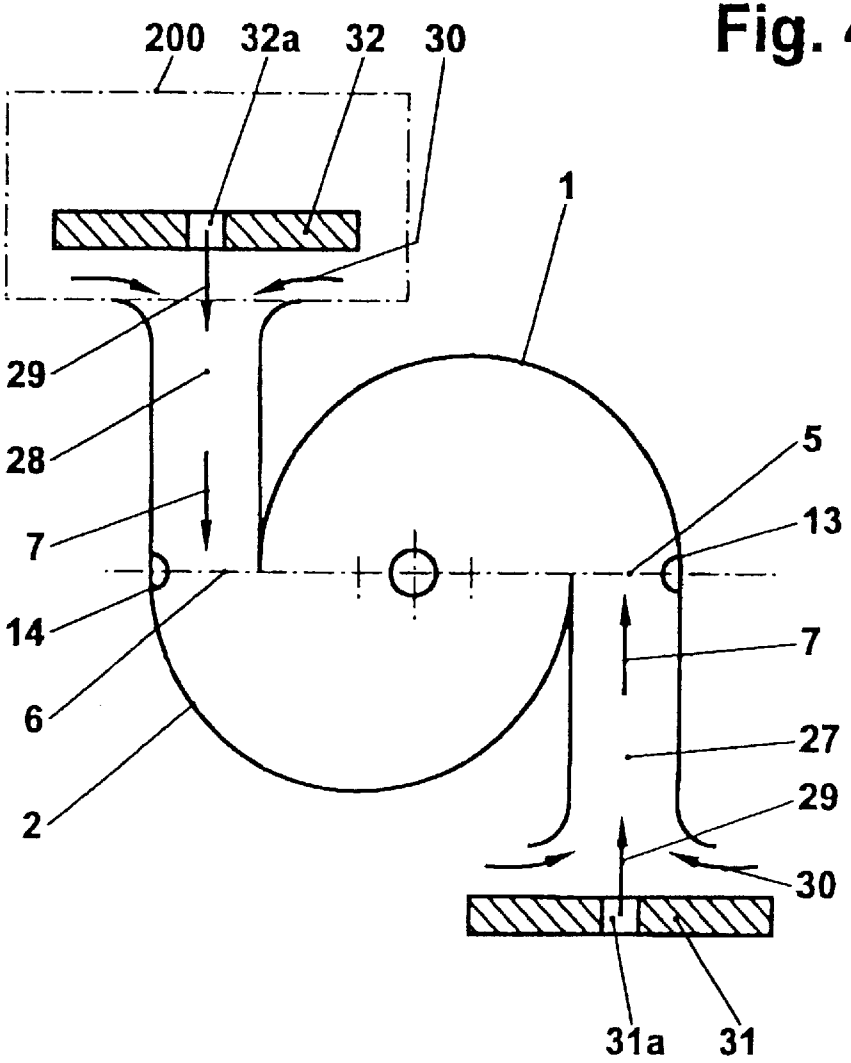
FIG. 4 shows a section through the premixing burner according to FIG. 2 or 3, equipped with injectors, the inflow plane of supply ducts running parallel to the burner axis.

FIG. 4 is a section approximately in the middle of the premixing burner. The supply ducts 27,28 tangentially arranged mirror-symmetrically perform the function of a mixing stage, in which the combustion air 7, formed from fresh air 29 and recirculated flue gas 30, is refined. The combustion air 7 is conditioned in an injector system 200. Upstream of each supply duct 27,28, which serves as a tangential inflow into the interior 8 of the premixing burner, the fresh air 29 is distributed uniformly over the entire length of the premixing burner via perforated plates 31,32. These perforated plates 31,32 are perforated in the direction of flow to the tangential inlet ducts 5,6. The perforations perform the function of individual injector nozzles 31*a*,32*a* which exert a suction effect relative to the surrounding flue gas 30, in such a way that each of these injector nozzles 31*a*,32*a* sucks in only a specific fraction of flue gas 30 in each case, whereupon uniform admixing of flue gas takes place over the entire axial length of the perforated plates 31,32 which corresponds to the burner length. This configuration ensures that intimate intermixing takes place as early as at the point of contact of the two media, that is to say, of the fresh air 29 and the flue gas 30, so that the flow length of the supply ducts 27,28, which reaches as far as the tangential air inlets 5,6, can be minimized for mixture formation. In addition, the injector configuration 200 here is distinguished in that the geometry of the premixing burner, particularly as regards the shape and size of the tangential air inlet ducts 5,6, remains dimensionally stable, that is to say no heat-related distortions occur because of the uniformly metered distribution of the flue gases 30, hot per se, along the entire axial length of the premixing burner. The same injector configuration as that just described here may also be provided in the region of the head-side fuel nozzle 11 for an axial supply of combustion air.

Figure 5:
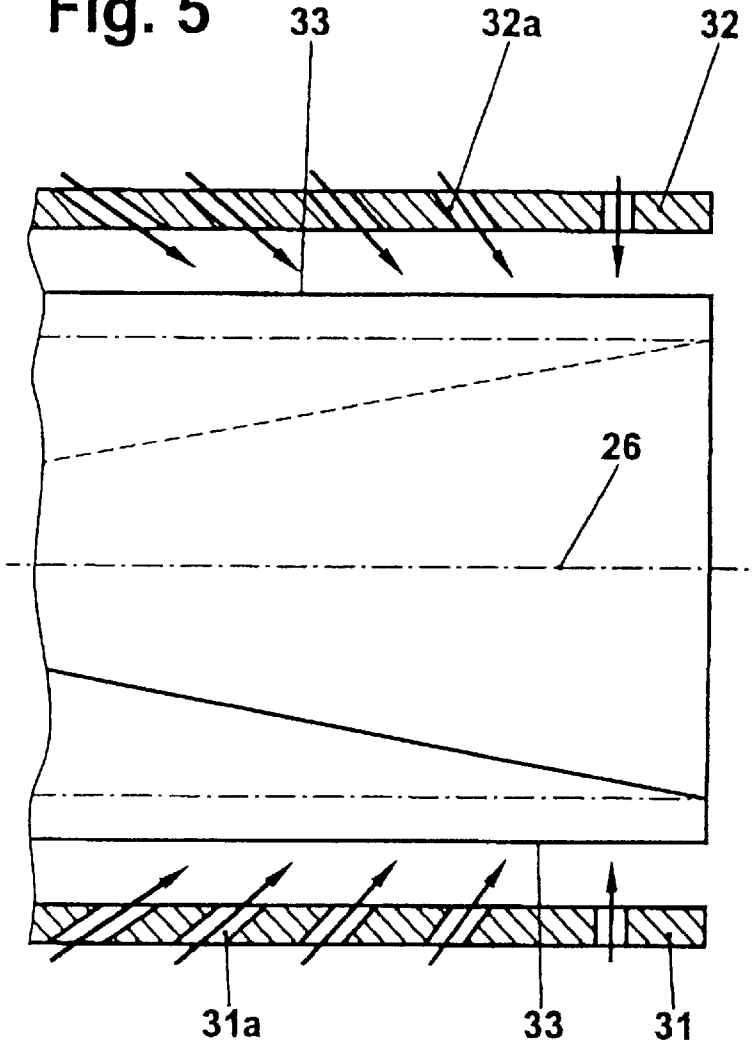
FIG. 5 shows a configuration of the injector system in the direction of flow.

FIG. 5 is a diagrammatic illustration of. the premixing burner in the direction of flow, revealing, in particular, the run of the perforated plates, 31,32, belonging to the injector system, in relation to the inflow planes 33 of the supply ducts 27,28. This run is parallel, the inflow planes 33 themselves running parallel to the burner axis 26 of the premixing burner over the entire burner length. It can also be seen from this figure how the injector nozzles 31*a*,32*a* vary their inflow angle relative to the burner axis 26 of the premixing burner in the direction of flow. From an initial acute angle in the region of the head stage of the premixing burner, they gradually straighten up, until they are approximately perpendicular to the burner axis 26 in the region of the exit. Due to this precaution, the mixing quality of the combustion air is increased and the backflow zone is kept in a stable position. The inflow angle of said injector nozzles relative to the burner axis may, however, be designed to be perpendicular in specific operating modes.

Figure 6:
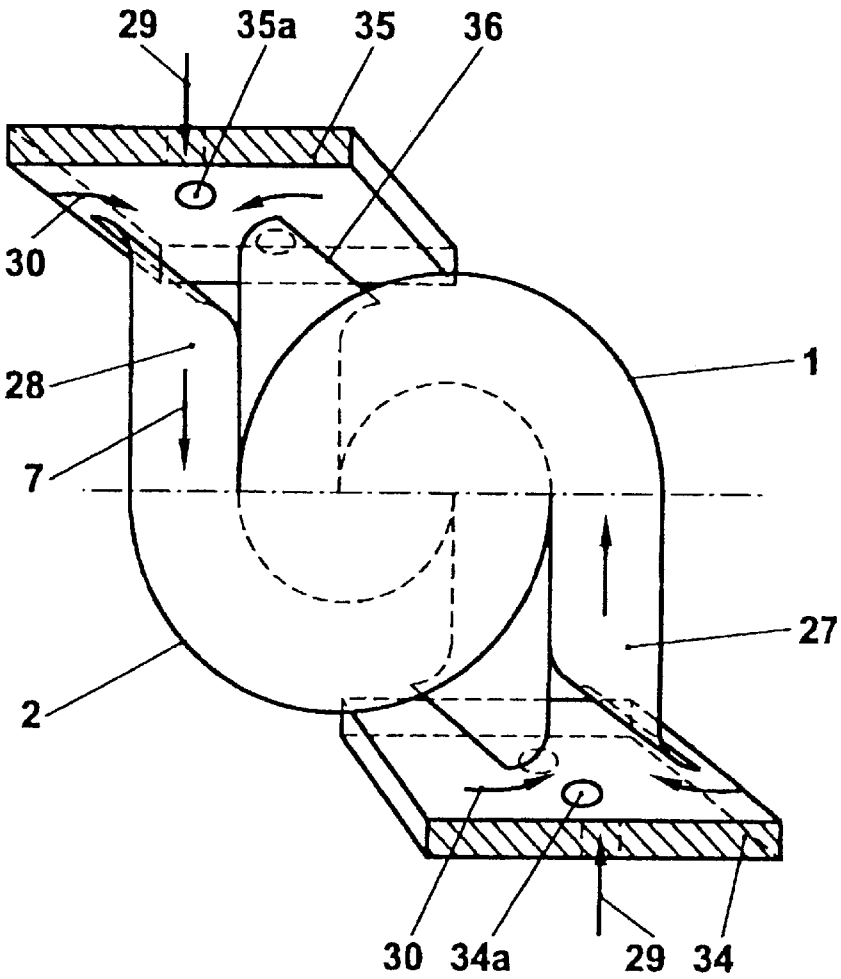
FIG. 6 shows a further embodiment of the inflow plane of supply ducts.
Figure 7:
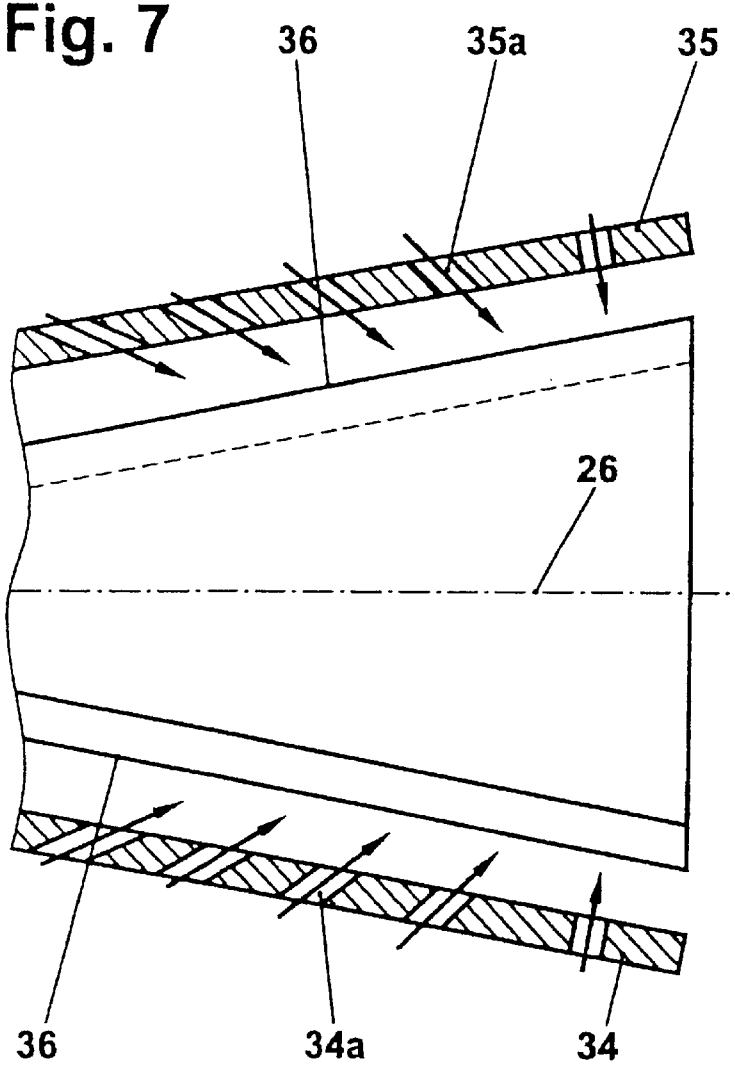
FIG. 7 shows a further configuration of the injector system in the direction of flow.

FIGS. 6 and 7 show essentially the same configuration according to FIGS. 4 and 5, the perforated plates 34,35, together with the associated injector nozzles 34*a*,35*a*, likewise running parallel to the inflow planes 36 of the supply ducts 27,28 over the entire burner length. However, these inflow planes 36 run conically relative to the burner axis 26 of the premixing burner. Here too, the variable inflow angle of the injector nozzles 34*a*,35*a* in the direction of flow corresponds largely to the configuration according to FIGS. 4 and 5, here the gradual straightening up of these injector nozzles 34*a*,35*a* into a perpendicular inflow in the region of the exit of the premixing burner taking place primarily in relation to the inflow plane 36 of the respective supply duct.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A method for operating a boiler plant for heat generation, the boiler plant including a fed air plenum and a combustion space in connection with the air plenum, and a burner operable with a liquid and/or gaseous fuel arranged on a head side of the combustion space, said burner comprising means for, at least in association with an introduction of combustion air from the air plenum, bringing about flame stabilization in the combustion space, and means for flue gas recirculation, said plenum being in connection with at least one blowoff device, said method comprising:

during a startup phase of the boiler plant, predeterminedly opening the blowoff device, thus temporarily lowering an admission pressure in the air plenum and the air mass flow through the burner, and thereby temporarily raising an equivalence ratio of the burner during the startup phase of the boiler plant.

* * * * *